US011384316B2

(12) United States Patent
Crutcher et al.

(10) Patent No.: US 11,384,316 B2
(45) Date of Patent: Jul. 12, 2022

(54) STABLE LAUNDRY CLEANING COMPOSITION AND METHOD COMPRISING A POLYAPTAC-CONTAINING POLYMER

(71) Applicant: ISP INVESTMENTS LLC, Wilmington, DE (US)

(72) Inventors: Terry Crutcher, Hillsborough, NJ (US); Raymond Rigoletto, Jr., Denville, NJ (US); Purvita Shah, Jersey City, NJ (US); Gijsbert Kroon, Giessenburg (NL)

(73) Assignee: ISP INVESTMENTS LLC, Wilmington, DE (US)

( * ) Notice: Subject to any disclaimer, the term of this patent is extended or adjusted under 35 U.S.C. 154(b) by 417 days.

(21) Appl. No.: 15/759,015

(22) PCT Filed: Sep. 9, 2016

(86) PCT No.: PCT/US2016/050951

§ 371 (c)(1),
(2) Date: Mar. 9, 2018

(87) PCT Pub. No.: WO2017/044749

PCT Pub. Date: Mar. 16, 2017

(65) Prior Publication Data

US 2020/0224128 A1 Jul. 16, 2020

Related U.S. Application Data

(60) Provisional application No. 62/217,129, filed on Sep. 11, 2015.

(51) Int. Cl.

| | |
|---|---|
| ***C11D 1/72*** | (2006.01) |
| ***C11D 3/386*** | (2006.01) |
| ***C11D 1/825*** | (2006.01) |
| ***C11D 3/00*** | (2006.01) |
| ***C11D 3/37*** | (2006.01) |

(52) U.S. Cl.
CPC ..... *C11D 3/386* (2013.01); *C11D 1/825* (2013.01); *C11D 3/0021* (2013.01); *C11D 3/3769* (2013.01)

(58) Field of Classification Search
CPC ..... C11D 1/72; C11D 1/825; C11D 3/001; C11D 3/386; C11D 11/0017; C11D 3/3719; C11D 3/3679
See application file for complete search history.

(56) References Cited

U.S. PATENT DOCUMENTS

| | | | | |
|---|---|---|---|---|
| 8,450,263 | B2 * | 5/2013 | Panandiker | C11D 3/373 510/475 |
| 2005/0124528 | A1 * | 6/2005 | Binder | C11D 3/3776 510/475 |
| 2006/0074005 | A1 * | 4/2006 | Kischkel | C11D 3/3773 510/504 |
| 2006/0199756 | A1 * | 9/2006 | Creamer | C11D 3/3796 510/475 |
| 2007/0128129 | A1 * | 6/2007 | Stehr | A61Q 5/08 424/50 |
| 2009/0155383 | A1 * | 6/2009 | Kitko | A61Q 5/006 514/159 |
| 2011/0053826 | A1 * | 3/2011 | Wise | C11D 11/0094 510/495 |
| 2011/0152154 | A1 * | 6/2011 | Loeffler | C11D 1/835 510/218 |
| 2013/0165572 | A1 | 6/2013 | Scheuing et al. | |
| 2014/0023609 | A1 * | 1/2014 | Mukherjee | C11D 3/3773 424/78.02 |
| 2014/0357540 | A1 * | 12/2014 | Smets | A61Q 19/10 510/102 |
| 2015/0105311 | A1 * | 4/2015 | Boutique | C11D 3/2093 510/296 |
| 2015/0376552 | A1 * | 12/2015 | Si | C08F 226/10 510/337 |
| 2016/0040104 | A1 * | 2/2016 | Liu | C11D 17/043 510/296 |
| 2016/0060574 | A1 * | 3/2016 | Panandiker | C11D 11/0017 8/137 |
| 2016/0312156 | A1 * | 10/2016 | Pan | C11D 3/3947 |
| 2017/0066997 | A1 * | 3/2017 | Chen | C11D 3/3773 |
| 2017/0266099 | A1 * | 9/2017 | Kroon | C08F 228/02 |
| 2018/0243199 | A1 * | 8/2018 | Kroon | A61Q 5/02 |

OTHER PUBLICATIONS

International Search Report, PCT/US2016/050951 published on Mar. 16, 2017.

* cited by examiner

*Primary Examiner* — Charles I Boyer
(74) *Attorney, Agent, or Firm* — William J. Davis

(57) ABSTRACT

Disclosed herein is a laundry or cleaning composition comprising (i) from about 0.001 wt. % to about 50 wt. % of at least one cationic polymer selected from the group consisting of poly acrylamidopropyl trimethyl ammonium chloride Poly(APTAC), polydiallyl dimethyl ammonium chloride poly(DADMAC), copolymers of polyAPTAC, copolymers of polyDADMAC, terpolymers of polyAPTAC, and/or terpolymers of polyDADMAC; (ii) from about 0.01 wt. % to about 50 wt. % of at least one non-ionic surfactant; (iii) optionally, from about 0.001 wt. % to about 5 wt. % of at least one enzyme; and (iv) optionally, from about 0.01 wt. % to about 25 wt. % of at least one laundry or cleaning additive, wherein said composition is capable of exhibiting color wash fastness or color maintenance.

11 Claims, 3 Drawing Sheets

STABLE LAUNDRY CLEANING COMPOSITION AND METHOD COMPRISING A POLYAPTAC-CONTAINING POLYMER

CROSS REFERENCE TO RELATED APPLICATIONS/INCORPORATION BY REFERENCE STATEMENT

The present application claims the benefit under 35 U.S.C. 119(e) of U.S. Provisional Application No. 62/217,129, filed Sep. 11, 2015, the entirety of which is hereby incorporated herein by reference.

FIELD OF THE INVENTION

The present application relates to a laundry or cleaning composition and more particularly, to a laundry or cleaning composition comprising a cationic polymer and a non-ionic surfactant for maintaining color appearance of laundered fabrics and/or garments.

BACKGROUND OF THE INVENTION

Individuals select clothes based on appearance, namely, color. They prefer to maintain the color of their clothes from time of purchase. Depending on the fabric type, how textiles are dyed, and treated prior to being made into clothing items, colored garments upon washing can be prone to color loss or fading as a result of usual and customary laundering. The color loss that occurs while washing contributes to problems that individuals would like to avoid including fading, wherein the loss of color and aged dull appearance due to dye loss. Another problem is free waterborne dye in the wash can transfer between clothes during the laundry from one garment to another creating undesirable color soiling or color staining that did not originally exist prior to laundering. It is highly desired to minimize and/or eliminate both color loss and color transfer while laundering clothes.

U.S. Pat. No. 8,728,172 assigned to The Procter & Gamble Company (P&G) discloses a method of delivering fabric care using a combination of cationic polymer and anionic surfactant.

U.S. Pat. No. 7,659,354 assigned to Ciba Specialty Chemicals Corporation discloses hydrophobically modified cationic polymers as laundry additives that inhibit the transfer of dyes or fix dyes on fabric surfaces to prevent bleeding. Further applications of such polymers include formulations to treat surfaces at home, and for indoor environment.

U.S. Published application 20080076692 assigned to Unilever discloses a softening wash detergent composition comprising detersive surfactant, soap, polymeric non-ionic surfactant and water soluble cationic polymer such as acrylamidopropyl trimethyl ammonium chloride (APTAC), wherein the surfactant and cationic polymer form a complex.

U.S. Published application 20060030513 assigned to Unilever discloses a laundry composition comprising a cationic polymer of APTAC/acrylamide copolymer, non-ionic oil and surfactant for softening of fabric.

CA Patent 2731711 assigned to P&G industries discloses a composition comprising homopolymers of diallyl dimethyl ammonium chloride (DADMAC) for color maintenance and/or rejuvenation benefit.

In view of the foregoing, there exists an unmet need for new and improved color care technologies to preserve fabric color. Accordingly, one aspect of the present application is to provide a color wash fastness or color maintenance composition that provides color preservation by preventing dye loss from a garment during a usual and customary laundry process or method over repeated wash cycles.

Accordingly, the present application demonstrates the color care benefit employing a particular class of cationic polymers to minimize color loss. Further, this application provides an additional advantage of dye transfer inhibition.

SUMMARY OF THE INVENTION

The primary objective of the present application is to provide a laundry or cleaning composition for color maintenance of laundered fabrics and/or garments using a cationic polymer with or without other laundry or cleaning additives.

Accordingly, one aspect of the present application is to provide a composition comprising (i) from about 0.0010 wt. % to about 50 wt. % of at least one cationic polymer selected from the group consisting of poly acrylamidopropyl trimethyl ammonium chloride (PolyAPTAC), polydiallyl dimethyl ammonium chloride (polyDADMAC), copolymers of polyAPTAC, copolymers of polyDADMAC, terpolymers of polyAPTAC, and/or terpolymers of polyDADMAC; (ii) from about 0.01 wt. % to about 50 wt. % of at least one non-ionic surfactant; (iii) optionally, from about 0.001 wt. % to about 5 wt. % of at least one enzyme; and (iv) optionally, from about 0.01 wt. % to about 25 wt. % of at least one laundry or cleaning additive, wherein said composition is capable of exhibiting color wash fastness or color maintenance.

In another aspect, the present application provides a laundry or cleaning composition comprising (i) from about 0.001 wt. % to about 50 wt. % of at least one cationic polymer selected from the group consisting of poly acrylamidopropyl trimethyl ammonium chloride (PolyAPTAC), polydiallyldimethylammonium chloride (polyDADMAC), copolymers of PolyAPTAC, copolymers of PolyDADMAC, terpolymers of PolyAPTAC, and/or terpolymers of PolyDADMAC; and (ii) from about 50 wt. % to about 99.999 wt. % of water as diluent, wherein said composition is capable of exhibiting color wash fastness or color maintenance.

According to another aspect of the present application, the cationic polymer is formulated in-situ during washing at laundry wash bath comprising (i) a cationic polymer of about 0.00001 wt. % to about 15.00 wt. %, preferably of about 0.0001 wt. % to about 5.0 wt. %, and (ii) water as required to provide a desired ready-to-use composition.

According to yet another aspect of the present application, the cationic polymer has a molecular weight of from about 1000 to 3,000,000 daltons, preferably 100,000 to 1,000,000 daltons.

In yet another aspect, the present application describes a method of providing appearance of reduced wrinkles and/or reduced lint of a fabric comprising the steps of (i) washing or contacting one or more fabrics or textile articles with wash solution containing a laundry or cleansing composition as described above at one or more points during the main wash of laundering or cleaning process; (ii) rinsing said fabrics or textile articles with water; (iii) and allowing the fabrics or textile articles to air dry naturally or mechanically tumble-drying them, and wherein the fabric is selected from the group consisting of natural fabric, synthetic fabric, natural non-woven fabric and/or synthetic non-woven fabric, cotton, denim, polyacrylics, polyamides, polyesters, polyolefins, rayon, wool, linen, jute, ramie, hemp, sisal, regenerated cellulosic fibers, leather, and combinations thereof.

According to still another aspect of the present application, the laundry or cleaning composition is capable of exhibiting color wash fastness or color maintenance of about 95% for 3-9 wash cycles.

Another aspect of the present application discloses laundry or cleaning compositions that are ready-to-use products, an additive rinse cycle composition, or a dilutable detergent for its use in house hold, industrial and/or commercial laundry operations.

BRIEF DESCRIPTION OF THE FIGURES

Further embodiments of the present application can be understood with the appended figures.

DETAILED DESCRIPTION OF THE INVENTION

Figure 1:
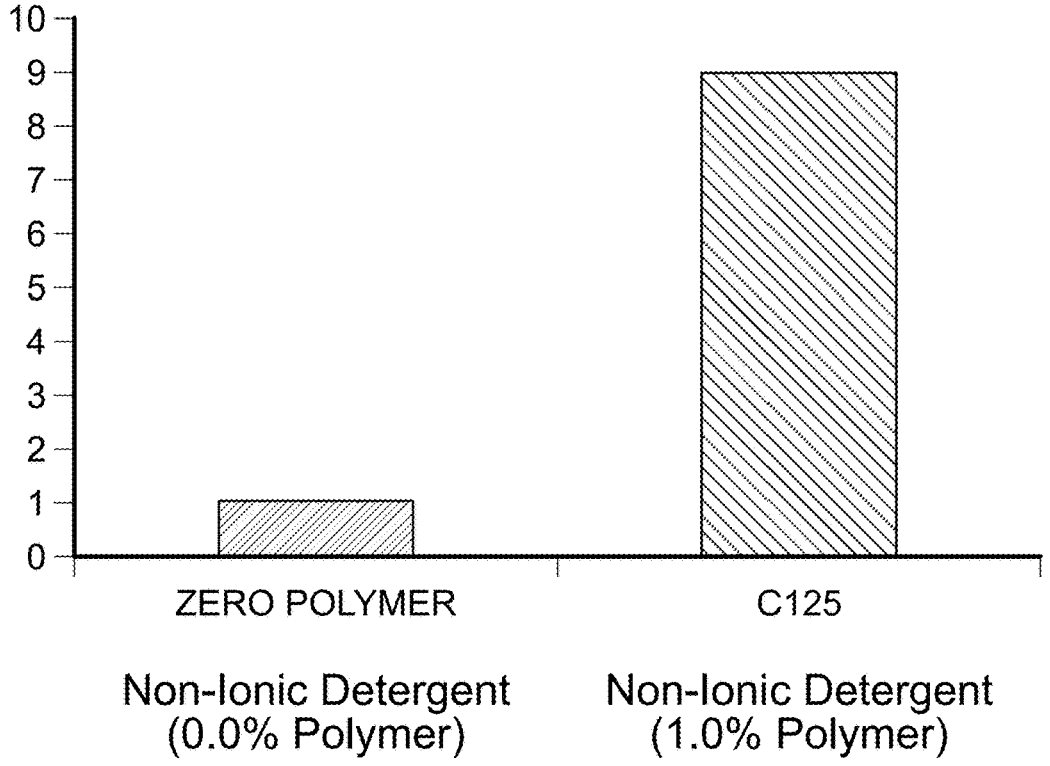
FIG. 1 depicts Visual Color Difference Panel Results on Blue Fabric using Detergent with zero polymer and zero detergent with polymer C125 (20%).

While this specification concludes with claims particularly pointing out and distinctly claiming that which is regarded as the invention, it is anticipated that the invention can be more readily understood through reading the following detailed description of the invention and study of the included examples.

As used herein, the term "comprising" refers that various optional, compatible components that can be used in the compositions herein, provided that the important ingredients are present in the suitable form and concentrations. The term "comprising" thus encompasses and includes the more restrictive terms "consisting of" and "consisting essentially of" which can be used to characterize the essential ingredients of the disclosed composition.

All references to singular characteristics or limitations of the present invention shall include the corresponding plural characteristic or limitation, and vice-versa, unless otherwise specified or clearly implied to the contrary by the context in which the reference is made.

Numerical ranges as used herein are intended to include every number and subset of numbers contained within that range, whether specifically disclosed or not. Further, these numerical ranges should be construed as providing support for a claim directed to any number or subset of numbers in that range.

As used herein, the words "preferred," "preferably" and variants thereof refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

References herein to "one embodiment," or "one aspect" or "one version" or "one objective" of the invention may include one or more of such embodiment, aspect, version or objective, unless the context clearly dictates otherwise.

All publications, articles, papers, patents, patent publications and other references cited herein are hereby incorporated herein by reference for all purposes to the extent consistent with the disclosure herein.

As used herein, the term "polymer" refers to a compound comprising repeating structural units (monomers) connected by covalent chemical bonds. The definition includes oligomers. Polymers may be further derivatized (example by hydrolysis), crosslinked, grafted or end-capped. Non-limiting examples of polymers include copolymers, terpolymers, quaternary polymers, and homologues. A polymer may be a random, block, or an alternating polymer, or a polymer with a mixed random, block, and/or alternating structure. Polymers may further be associated with solvent adducts.

As used herein, the term "homopolymer" refers to a polymer consisting essentially of a single type of repeating structural unit (monomer). The definition includes homopolymers with solvent adducts.

As used herein, the term "copolymer" refers to a polymer consisting essentially of two types of repeating structural units (monomers). The definition includes copolymers having solvent adducts.

As used herein, the term "cationic polymer" as used herein, indicates any polymer containing cationic groups and/or ionizable groups in cationic groups. The suitable cationic polymers are chosen from among those containing units including primary, secondary, tertiary, and/or quaternary amine groups.

As used herein, the term "cationic polymer" also refers to poly acrylamidopropyl trimethyl ammonium chloride Poly (APTAC) homopolymer, copolymers of APTAC, terpolymers of APTAC, and tetra polymers of APTAC. A homopolymer by definition herein consists of one monomer, polyAPTAC. Copolymers by definition herein, consist of two different monomers by description polyAPTAC and a second different monomer. Terpolymers by definition herein consist of three different monomers and by description consist of polyAPTAC and two other monomers, each different. The prior logic follows for APTAC tetra polymers and so forth. Structural diagram of Poly(APTAC) is provided below:

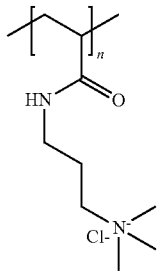

Poly(APTAC)

As used herein, the term "cationic polymer" further refers to poly diallyldimethyl ammonium chloride (polyDADMAC) homopolymer, copolymers of DADMAC, terpolymers of DADMAC, and tetra polymers of DADMAC. A homopolymer by definition herein consists of one monomer, polyDADMAC. Copolymers by definition herein, consist of two different monomers by description polyDADMAC and second different monomer. Terpolymers by definition herein consist of three different monomers and by description consist of polyDADMAC and two other monomers, each different. The prior logic follows for DADMAC tetra polymers and so forth. Structural diagram of Poly(DADMAC) is provided below:

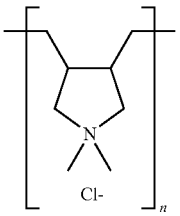

Poly(DADMAC)

As used herein, the term "color wash fastness" refers to maintaining the color of clothes and fabrics when they are exposed to the process and conditions of laundering or washing. Washing clothes is known to change the color and thus appearance of the fabrics from its original color. A dye may be reasonably fast to one agent and only moderately fast to another.

As used herein, the term "Hunter Lab Color Quest XE" refers to a spectrophotometer instrument which measures the precise color.

As used herein, the term "color index or color index value" refers to the ratio of the absolute value of coordinates "a" or "b" divided by coordinate L of the L, a, b, Hunter Lab Color Scale. Higher color index value corresponds to better color retention and color wash fastness. The index values are internal data sets and performance rankings; significant difference is plus or minus 0.001. Index rankings have been found to correlate with visual color panel test results.

What is described herein is a laundry or cleaning composition for color maintenance of laundered fabrics and/or garments using a cationic polymer comprising (i) from about 0.001 wt. % to about 50 wt. % of at least one cationic polymer selected from the group consisting of poly acrylamidopropyl trimethyl ammonium chloride (PolyAPTAC), polydiallyl dimethyl ammonium chloride (polyDADMAC), copolymers of PolyAPTAC, copolymers of PolyDADMAC, terpolymers of PolyAPTAC, and/or terpolymers of PolyDADMAC; (ii) from about 0.01 wt. % to about 50 wt. % of at least one non-ionic surfactant; (iii) optionally, from about 0.001 wt. % to about 5 wt. % of at least one enzyme; and (iv) optionally, from about 0.01 wt. % to about 25 wt. % of at least one laundry or cleaning additive.

According to a non-limiting embodiment of the present application, the cationic polymer is present in an amount of from about 1 wt. % to about 5 wt. %, about 6 wt. % to about 10 wt. %, about 11 wt. % to about 15 wt. %, about 16 wt. % to about 20 wt. %, about 21 wt. % to about 25 wt. %, or about 26 wt. % to about 30 wt. %.

Accordingly, the cationic polymer is present in an amount not limiting to about 0.0001 wt. % to about 0.1 wt. %; about 0.2 wt. % to about 1.0 wt. %; or about 2 wt. % to about 5 wt. %.

Accordingly, the cationic polymer is present in an amount not limiting to about 0.0001 wt. % to 0.008 wt. %, about 0.001 wt. % to 0.004 wt. % and about 0.0015 wt. % to about 0.003 wt. %.

According to a non-limiting embodiment of the present application, the cationic polymer has an average molecular weight of from about 1000 to about 3,000,000 daltons and preferably from about 100,000 to about 1,000,000 daltons. Other non-limiting range of molecular weight of cationic polymers would include about 1000 to 10,000, about 10,000 to about 50,000, about 50,000 to about 100,000, about 100,000 to about 500,000, about 500,000 to about 1000,000, about 1000,000 to about 2000,000 and about 2000,000 to about 3000,000.

Useful cationic polymers include known polyamine, polyaminoamide, and quaternary polyammonium types of polymers, such as:

(1) Homopolymers and copolymers derived from acrylic or methacrylic esters or amides. The copolymers can contain one or more units derived from acrylamides, methacrylamides, diacetone acrylamides, acrylamides and methacrylamides, acrylic or methacrylic acids or their esters. Specific examples include: copolymers of acrylamide and dimethyl amino ethyl methacrylate quaternized with dimethyl sulfate or with an alkyl halide; copolymers of acrylamide and methacryloyloxyethyl trimethyl ammonium chloride; the copolymer of acrylamide and methacryloyloxyethyl trimethyl ammonium methosulfate; (2) Derivatives of cellulose ethers containing quaternary ammonium groups, such as hydroxyethyl cellulose quaternary ammonium that has reacted with an epoxide substituted by a trimethyl ammonium group. (3) Derivatives of cationic cellulose such as cellulose copolymers or derivatives of cellulose grafted with a hydro soluble quaternary ammonium monomer, as described in U.S. Pat. No. 4,131,576, such as the hydroxyalkyl cellulose, and the hydroxymethyl-, hydroxyethyl- or hydroxypropyl-cellulose grafted with a salt of methacryloyl ethyl trimethyl ammonium, methacrylamidopropyl trimethyl ammonium, or dimethyl diallyl ammonium. (4) Cationic polysaccharides such as described in U.S. Pat. Nos. 3,589,578 and 4,031,307, guar gums containing cationic trialkyl ammonium groups, guar gums modified by a salt, e.g., chloride of 2,3-epoxy propyl trimethyl ammonium, Cassia, Chitosan, Chitin and the like. (5) Polymers composed of piperazinyl units and alkylene or hydroxy alkylene divalent radicals with straight or branched chains, possibly interrupted by atoms of oxygen, sulfur, nitrogen, or by aromatic or heterocyclic cycles, as well as the products of the oxidation and/or quaternization of such polymers. (6) Water-soluble polyamino amides prepared by polycondensation of an acid compound with a polyamine. These polyamino amides may be reticulated. (7) Derivatives of polyamino amides resulting from the condensation of polyalcoylene polyamines with polycarboxylic acids followed by alcoylation by bi-functional agents. (8) Polymers obtained by reaction of a polyalkylene polyamine containing two primary amine groups and at least one secondary amine group with a dioxycarboxylic acid chosen from among diglycolic acid and saturated dicarboxylic aliphatic acids having 3 to 8 atoms of carbon. Such polymers are described in U.S. Pat. Nos. 3,227,615 and 2,961,347. (9) The cyclopolymers of alkyl diallyl amine or dialkyl diallyl ammonium such as the homopolymer of dimethyl diallyl ammonium chloride and copolymers of diallyl dimethyl ammonium chloride and acrylamide. (10) Quaternary diammonium polymers such as hexadimethrine chloride. Polymers of this type are described particularly in U.S. Pat. Nos. 2,273,780, 2,375,853, 2,388,614, 2,454,547, 3,206,462, 2,261,002, 2,271,378, 3,874,870, 4,001,432, 3,929,990, 3,966,904, 4,005,193, 4,025,617, 4,025,627, 4,025,653, 4,026,945, and 4,027,020. (11) Quaternary polyammonium polymers, including, for example, Mirapol® A 15, Mirapol® AD1, Mirapol® AZ1, and Mirapol® 175 products sold by Miranol. (12) Quaternary polyamines. (13) Reticulated polymers known in the art.

Non-limiting cationic polymers for the present application include N-tert-butylaminoethyl(meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate and N,N-dimethylaminocyclohexyl (meth)acrylate, dimethylaminomethylacrylate, diethylamino methylacrylate, dimethylaminoethylacrylate, dimethylamino butylacrylate, dimethylamino butylmethacrylate, dimethylaminoamylmethacrylate, diethylaminoamyl methacrylate, dimethylaminohexylacrylate, diethylaminohexyl methacrylate, dimethylaminooctylacrylate, dimethylaminooctylmethacrylate, diethylaminooctyl acrylate, diethylaminooctyl methacrylate, dimethylaminodecyl methacrylate, dimethyl aminododecylmethacrylate, diethylaminolaurylacrylate. Diethylaminolauryl methacrylate, dimethylaminostearylacrylate, dimethylamino stearyl methacrylate, diethylaminostearyl acrylate and diethylaminostearyl methacrylate. Particularly useful are N-tert-butylaminoethyl (meth)acrylate and N,N-dimethylaminoethyl (meth)acrylate. Particular preference is furthermore given to N,N-dimethylaminoethyl acrylate and N,N-dimethylaminoethyl methacrylate. Further, the suitable amide based cationic non-homopolymer may be selected from a group of compounds including, but not limited to, α,β-ethylenically unsaturated mono and dicarboxylic acids with diamines having at least one primary or secondary amino group in it. The choice is provided to diamines which have one tertiary and one primary or secondary amino group. The most appropriate monomers include, but are not limited to, N-tert-butylaminoethyl(meth)acrylamide, N-[2-(dimethylamino) ethyl] acrylamide, N-[2-(dimethylamino)ethyl]methacrylamide, N-[3-(dimethylamino)propyl] acrylamide, N-[3-(dimethylamino)propyl] methacrylamide, N-[4-(dimethylamino)butyl] acrylamide, N-[4-(dimethylamino) butyl] methacrylamide, N-[2-(diethylamino) ethyl] acrylamide, N-[4-(dimethylamino)cyclohexyl] acrylamide and N-[4-(dimethyl amino) cyclohexyl] methacrylamide, N-[12-(dimethylamino) dodecyl]-methacrylamide, N-[18-(dimethylamino)octadecyl]methacrylamide, N-[8-(dimethylamino)octyl]methacryl amide, N-[7-(dimethylamino)heptyl]acrylamide, [14-(dimethylamino)tetradecyl] acrylamide, [3-(dimethylamino)propyl]methacrylamide, N-[3-(diethylamino)propyl] acrylamide, N-(4-(dipropylamino)butyl] methacrylamide, N-[3-(methylbutylamino) propyl] acrylamide, N-(2-[3-(dimethylamino)propyl]ethyl)acrylamide, N-(4-[4-(diethylamino)butyl] butyl) acrylamide. Special significance is given to N-[3-(dimethylamino)propyl]acrylamide, N-[3-(dimethylamino) propyl]methacrylamides (DMAPMA) and mixtures thereof.

According to another important embodiment of the present application, the copolymers, terpolymers and/or tetrapolymers of cationic non-homopolymer can be selected from a group comprising, but not limited to, a group of compounds having α,β-ethylenically unsaturated double bond and at least one cationogenic and/or cationic group per molecule. The compounds may be selected from the esters of α,β-ethylenically unsaturated mono and dicarboxylic acids with amino alcohols and in some cases the amino alcohols may be $C_2$-$C_{20}$-amino alcohols which are $C_1$-$C_8$ mono or dialkylated on the nitrogen atom of the amine functional group. Cationic non-homo polymer may be (a) homo- or copolymers of acrylic or methacrylic acid or salts thereof; (b) copolymers of acrylic or methacrylic acids with a monoethylenic monomer such as ethylene, styrene, vinyl esters, acrylic acid esters or methacrylic acid esters. These copolymers can be grafted onto a polyalkylene glycol and optionally crosslinked; (c) copolymers comprising: (i) one or more maleic, fumaric or itaconic acids or anhydrides and (ii) at least one monomer selected from vinyl esters, vinyl ethers, vinyl halides, phenyl vinyl derivatives, acrylic acid and its esters, the anhydride functions of these copolymers optionally being monoesterified or monoamidated; (d) copolymers comprising: (i) one or more maleic, citraconic or itaconic anhydrides and (ii) one or more monomers selected from allylic or methallylic esters optionally containing one or more acrylamide, methacrylamide, alphaolefin, acrylic or methacrylic ester, acrylic or methacrylic acid or vinylpyrrolidone groups in their chain, the anhydride functions of these copolymers optionally being monoesterified or monoamidated; (e) polyacrylamides containing carboxylate groups; (f) polymers comprising sulphonic groups are polymers containing vinylsulphonic, styrenesulphonic, naphthalenesulphonic or acrylamidoalkylsulphonic units. The suitable acid components of these esters are, for example, acrylic acid, methacrylic acid, fumaric acid, maleic acid, itaconic acid, crotonic acid, maleic anhydride, monobutyl maleate alone or in combination thereof. Acrylic acid, methacrylic acid and mixtures thereof are particularly useful.

According to another important embodiment of the present application, the copolymers, terpolymers and/or tetrapolymers of cationic non-homopolymers can be prepared by employing at least one hydrophobic or non-ionic monomer selected from the group comprising, but not limited, to vinyl 2-ethylhexanoate, vinyl laurate, vinyl stearate, vinyl alkyl or aryl ethers with ($C_9$-$C_{30}$) alkyl groups such as stearyl vinyl ether; ($C_6$-$C_{30}$) alkyl esters of (meth-)acrylic acid, such as hexyl (meth)acrylate, heptyl (meth)acrylate, octyl (meth)acrylate, isooctyl acrylate, isononyl acrylate, decyl (meth)acrylate, isodecyl (meth)acrylate, dodecyl (meth)acrylate, 2-ethylhexyl (meth)acrylate, benzyl (meth) acrylate, lauryl (meth)acrylate, oleyl (meth)acrylate, palmityl (meth)acrylate, polyoxyethylene (PEG)-18-behenylether methacrylate (BEM), polyoxyethylene (PEG)-18-stearylether methacrylate (SEM), Steareth-10-allyl-ether and stearyl (meth)acrylate; unsaturated vinyl esters of (meth)acrylic acid such as those derived from fatty acids and fatty alcohols; monomers derived from cholesterol; olefinic monomers such as 1-butene, 2-butene, 1-pentene, 1-hexene, 1-octene, isobutylene and isoprene.

In a specific embodiment of the present application, the cationic non homopolymer may be selected from a group of quaternized ammonium compounds such as diethyldiallyl ammonium chloride (DEDAAC) dimethyldiallyl ammonium chloride (DMDAAC), methacryloyloxy ethyl trimethyl ammonium methylsulfate (METAMS), methacrylamido propyl trimethyl ammonium chloride (MAPTAC), acryloyloxyethyl trimethyl ammonium chloride (AETAC), methacryloyloxyethyl trimethyl ammonium chloride (METAC), acrylamidomethylpropyl trimethyl ammonium chloride (AMPTAC), acrylamidomethyl butyl trimethyl ammonium chloride (AMBTAC) and mixtures thereof. Particularly useful cationic-containing monomers are MAPTAC, DMDAAC, DEDAAC and METAC alone or copolymerized with acrylamide, methacrylamide and N,N-dimethylacrylamide.

According to another embodiment of the present application, one or more various cationic polymers belonging to "polyquaternium" (PQ) family of polymers may be included in the compositition. The suitable PQ compounds include, but are not limited to: PQ-2, PQ-4, PQ-5, PQ-6, PQ-7, PQ-8, PQ-9, PQ-10, PQ-11, PQ-14, PQ-16, PQ-17, PQ-18, PQ-19, PQ-20, PQ-21, PQ-22, PQ-24, PQ-27, PQ-28, PQ-29, PQ-31, PQ-32, PQ-37, PQ-39, PQ 41, PQ-42, PQ-44, PQ-46, PQ-47, PQ-48, PQ-49, PQ-50, PQ-55, PQ-69 and other quaternary ammonium compounds are listed in the CTFA Cosmetic Ingredient Handbook, First Edition, on pages 41-42, incorporated herein by reference, and are described in the "History of Polymers in Haircare," Cosmetics and Toiletries, 103 (1988), incorporated herein by reference. Other synthetic polymers that may be used with the present application can be referenced in the CTFA Dictionary, Fifth Edition, 2000, incorporated herein by reference.

According to one important embodiment of the present application, the cationic polymer is homopolymer, copolymer or terpolymer is selected from the group comprising (i) poly(acrylamidopropyltrimethylammoniumchloride) (polyAPTAC), (ii) poly(diallyl dimethyl ammonium chloride), (iii) poly(acrylamido propyl trimethyl ammonium chloride-behenyl methacrylate-acrylic acid) terpolymer, (iv) poly (acrylamido propyl trimethyl ammonium chloride-stearyl acrylate-acrylic acid) terpolymer, (v) poly(acrylamido propyl trimethyl ammonium chloride-stearyl acrylate-acrylamidopropyl methane sulfonic acid) terpolymer. Homopolymer of APTAC is poly (acrylamido propyl trimethyl ammonium chloride) (polyAPTAC) as described herein is also referred to as C-125 polymer.

In one embodiment of the present application, the above disclosed homopolymers, terpolymers and tetrapolymers advantageously can be combined and formulated with at least one non-ionic surfactant, and/or other color care additives that are compatible with the cationic polymer and non-ionic surfactant of the present application.

According to one important embodiment of the present application, it is contemplated to employ at least one copolymer in laundry and cleaning composition of the present application for exhibiting color wash fastness or color maintenance of fabrics or garments, and wherein, the copolymer is obtained from polymerizing: (i) about 0.1 wt. % to 99.9 wt. % of at least one cationic or pseudo-cationic monomer selected from the group consisting of acrylamidopropyl trimethylammonium chloride (APTAC) and/or diallyl dimethyl ammonium chloride (DADMAC), Acryloyloxyethyltrimethylammoniumchloride (AETAC), Methacrylamidopropyl trimethylammonium chloride (MAPTAC), Dimethylaminoethyl methacrylate (DMAEMA or MADAME), Methyloyloxyethyl trimethyl ammonium chloride (METAC), Dimethylaminopropylmethacrylamide N-(3-chloro-2-hydroxypropyl) trimethylammonium chloride (DIQUAT chloride), and/or Vinylpyrrolidone (VP); and (ii) about 0.1 wt. % to 99.9 wt. % of at least one monomer comprising at least one functionalized or unfunctionalized acryloyl moiety and at least one lactam moiety.

According to another important embodiment of the present application, it is contemplated to employ at least one terpolymer or tetrapolymer in laundry and cleaning composition of the present application for exhibiting color wash fastness or color maintenance of fabrics or garments, and wherein, the terpolymer or tetrapolymer is obtained from polymerizing: (i) about 0.1 wt. % to 99.9 wt. % of at least one cationic or pseudo-cationic monomer selected from the group consisting of acrylamidopropyl trimethylammonium chloride (APTAC) and/or diallyl dimethyl ammonium chloride (DADMAC), Acryloyloxyethyltrimethylammoniumchloride (AETAC), Methacrylamido propyl trimethylammonium chloride (MAPTAC), Dimethylaminoethylmethacrylate (DMAEMA or MADAME), Methyloyloxyethyl trimethylammonium chloride (METAC), Dimethylaminopropylmethacryl amide, N-(3-chloro-2-hydroxypropyl) trimethyl ammonium chloride (DIQUAT chloride), and/or Vinylpyrrolidone (VP); (ii) about 1 wt. % to 99.9 wt. % of at least one anionic monomer selected from the group consisting of (a) acrylic acid (AA) or methacrylic acid, (b) acrylamidomethylpropyl sulfonate (AMPS), and/or (c) sodium methyl allyl sulfonate (SMAS); (iii) about 0.1 wt. % to 99.9 wt. % of at least one monomer comprising at least one functionalized or unfunctionalized acryloyl moiety and at least one lactam moiety.

The functionalized or unfunctionalized acryloyl moiety as described herein and preceding paragraphs has the structure of:

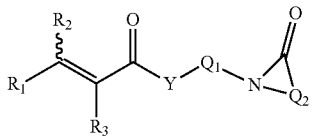

(1)

wherein each $R_1$ $R_2$ and $R_3$ is independently selected from the group consisting of hydrogen, halogens, functionalized and unfunctionalized $C_1$-$C_4$ alkyl, and;

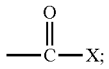

each X is independently selected from the group consisting of $OR_4$, OM, halogen, $N(R_5)(R_6)$,

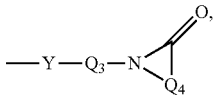

and combinations thereof;

each Y is independently oxygen, $NR_7$ or sulfur;

each $R_4$, $R_5$, $R_6$ and $R_7$ is independently selected from the group consisting of hydrogen, methyl, functionalized and unfunctionalized alkyl;

each M is independently selected from the group consisting of metal ions, ammonium ions, organic ammonium cations, and combinations thereof; and each $Q_1$, $Q_2$, $Q_3$, and $Q_4$ is independently selected from the group consisting of functionalized and unfunctionalized $C_1$-$C_{12}$ alkylene.

Further, a specific embodiment reveals that $R_1$ and $R_3$ of (I) is independently hydrogen or methyl; said $R_2$ of (I) is

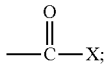

X is selected from the group consisting of $OR_4$, OM, halogens, and $N(R_5)(R_6)$; each $R_4$, $R_5$, and $R_6$ of (I) is independently selected from the group consisting of hydrogen and functionalized and unfunctionalized alkyl; and each M is independently selected from the group consisting of metal ions, ammonium ions, organic ammonium cations, and combinations thereof.

One important embodiment of the present application is to employ surfactants that are active cleaning agents used in penetrating and wetting fabrics, loosening soils and emulsifying soils and keeping them suspended in wash solution. Surfactants are either derived from petrochemicals, vegetable oils or animal fats or combinations of other sources. Accordingly, the preferred surfactants for the present application is selected from anionic, non-ionic and/or cationic types that are known in the prior art for a person skilled in the pertinent art. Anionic surfactants are the most common surfactants employed in laundry detergents are not recommended for the present application. In detergent compositions typically cationic polymers are not compatible with anionic surfactants due to their positive charge. In presence of cationic polymers, anionic surfactants tend to form complexes which phases out the resulting detergent compositions that are unstable and therefore unsuitable for commercialization.

Non-ionic surfactants have a neutral (non-polar) head group are not deactivated by ions or charged particles that are present in the hard water. Non-ionic water-soluble surfactants are suitable for use in the present application and can be selected from the group comprising alkoxylated alkyl phenols, alkoxylated alcohols, alkoxylated glycosides and mixtures thereof. Non-limiting examples of non-ionic surfactants for the present application are as follows:

(1) Polyethylene oxide extended sorbitan monoalkylates (i.e. Polysorbates); (2) Polyalkoxylated alkanols; (3) Polyalkoxylated alkyl phenols include polyethoxylated octyl or nonyl phenols having HLB values of at least about 14, which are commercially available under the trade designations ICONOL and TRITON; (4) Polaxamers. Surfactants based on block copolymers of ethylene oxide (EO) and propylene oxide (PO) may also be effective. Both EO-PO-EO blocks and PO-EO-PO blocks are expected to work well as long as the HLB is at least about 14, and preferably at least about 16. (5) Polyalkoxylated esters—Polyalkoxylated glycols such as ethylene glycol, propylene glycol, glycerol, and the like may be partially or completely esterified, i.e. one or more alcohols may be esterified, with a ($C_8$ to $C_{22}$) alkyl carboxylic acid. Such polyethoxylated esters having an HLB of at least about 14, and preferably at least about 16, may be suitable for use in compositions of the present invention; (6) Alkyl Polyglucosides—This includes glucopon 425, which has a ($C_8$ to $C_{16}$) alkyl chain length.

Preferred alkoxylated alkyl phenols include the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 2 to about 25 moles of ethylene oxide per mole of alkyl phenol. Preferred alkoxylated alkyl phenols are nonylphenol 9 mole ethoxylate and octylphenol 9 mole ethoxylate. Commercially available nonionic surfactants of this type include Igepal™ marketed by the Stepan Company; and Triton™ marketed by the Dow Chemical Company.

Useful alkoxylated alcohols include the alkyl ethoxylate condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Preferred alkoxylated alcohols include dodecyl alcohol 7 mole ethoxylate, tridecyl alcohol 7 mole ethoxylate, tetradecyl alcohol 7 mole ethoxylate, dodecyl/pentadecyl alcohol 7 mole ethoxylate blend and hexadecyl alcohol 7 mole ethoxylate.

Suitable alkoxylated glycosides include alkylpolysaccharides disclosed in U.S. Pat. No. 4,565,647 (Llenado) having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties.

"Detersive enzyme", as used herein, means any enzyme having a cleaning, stain removing or otherwise beneficial effect in detergent compositions. The compositions of the present application may optionally include one or more detersive enzymes, either singly or in any combination of two or more. Enzymes may be included in the present detergent compositions for a variety of purposes, including removal of protein-based, carbohydrate based, or triglyceride-based stains from substrates. Whatever the type of stain, after its enzymatic breakdown, surfactants suspend the resulting fragments in solution. Enzymes can also help remove fuzz and pills, and can assist color protection of fabrics. Generally, suitable non-limiting enzymes include cellulases, hemicellulases, proteases, gluco-amylases, amylases, lipases, cutinases, pectinases, xylanases, keratinases, reductases, oxidases, phenoloxidases, lipoxygenases, ligninases, pullulanases, tannases, chondriotinases, thermitases, pentosanases, malanases, β-glucanases, arabinosidases or mixtures thereof of any suitable origin, such as vegetable, animal, bacterial, fungal and yeast origin. Suitable enzymes for use in the present application are dictated by factors such as formula pH, thermostability, and stability to surfactants, builders and the like. Proteases aid in removal of proteinaceous stains like blood, milk, cocoa; Amylase aids in the removal of starch like stains; Lipases aid in the removal of fatty ester stains like butter, and vegetable oils, hydrolysis of triglycerides; cellulase aids in the removal of cotton fibrils off garments, and mixtures. The proteases for use in the detergent compositions herein include but are not limited to trypsin, subtilisin, chymotrypsin and elastase-type proteases. The compositions of the present application employ at least about 0.0001%, at least about 0.0005%, and at least about 0.001% by weight of the composition of enzyme. The detergent composition further contains no more than about 5%, preferably no more than about 2%, and more preferably no more than about 1% by weight of the composition of enzyme. Although proteases may be used alone, a combination of protease and amylase, or a combination of protease, lipase and amylase in the compositions may also be employed in the present application.

Builders soften water by complexing with calcium and magnesium ions which then do not interfere with the action of surfactants. Accordingly, it is contemplated to employ water softening builders include sequestrating builders selected from sodium tripolyphosphate (STPP); tetrasodium pyrophosphate, hexametaphosphate, and tetrapotassium pyrophosphate, citrates, tartrate, succinates, gluconates, polycarboxylates, ethylenediamine tetraacetic acid (EDTA), diethylene triamine pentaacetic acid (DTPA), hydroxyethylene diamine triacetic acid (HEDTA), dihydroxyethyl glycine (DEG), and triethanolamine; precipitating builders selected such as sodium carbonate and ion exchange builders such as zeolites and sodium disilicate.

Another embodiment of the present application contemplates to employ anti-redeposition agents that prevent soils that have been dislodged from fabric from being redeposited such as Carboxy methyl cellulose (CMC), Polyvinyl pyrrolidone Polyethylene glycol (PEG) and polyvinyl alcohol may also be used as anti-redeposition agents.

In another embodiment of the present application, fabric softeners are employed, wherein the fabric softeners are cationic surfactants, having their polar head-groups bear a positive charge. These are attracted to the negatively charged fabric surface and associate with the fibres. With the positively charged head group associated with the fabric, the fatty tail protrudes from the surface and imparts a feeling of softness or smoothness to the fabric. The layer of molecules on the surface may also endow the fabric with some waterproofing properties. Non-limiting examples of fabric softeners include quaternary ammonium compounds such as dihydrogenated tallow dimethyl ammonium chloride and methyl bis-2-hydroxyethyl ammonium methyl sulfate.

Optical brighteners or whitening agents mask the appearance of an undesirable color, such as the yellowing of fabric that occurs naturally over time by introducing a complementary color. Optical brighteners attach to fabrics, absorb invisible ultraviolet light and convert it to visible blue-violet light. The blue light that is emitted interacts with the yellow light emitted by the fabric, giving an overall appearance of whiteness. Optical brighteners include aminotriazines, coumarins and stilbenes. Brighteners are also disclosed in Kirk-Othmer Encyclopedia of Chemical Technology, John Wiley & Sons (1985) at pp. 184-185.

Hydrotropes or solubilizers, assist in maintaining the pouring characteristics of liquid detergents by preventing gel formation or separation into layers in the bottle. They maintain a uniform composition throughout the liquid detergent. Hydrotropes includes xylene sulfonate, cumene sulfonate, some glycol ether sulphates and urea.

Foam regulators inhibit the formation of suds the washing cycle. Foam regulators prevent the formation of foam by disrupting the surfactants at the air-water interface of the forming bubble, or cause foam bubbles to collapse by forming hydrophobic bridges across multiple bubbles selected from soaps, siloxanes and paraffins.

Other color care additives which can be included to the composition can be selected from the group comprising dispersants, fillers compounds, functional polymers, stabilizers, rheology modifiers, solvents, soil release polymers, preservatives, fragrances, antimicrobials, insect repellents, dust mite repellents, UV absorbers, bleaching agents, oxidation catalysts, zeolites, and/or odor suppressing agents. A complete list of ingredients routinely added to cleaning compositions is found in McCutcheon's 2012 Emulsifiers & Detergents and McCutcheon's Functional Materials directories of detergent ingredients.

Without being bound by the theory, applicants believe that a color retention benefit is delivered to a fabric or garment through a composition comprising cationic polymer, non-ionic surfactant and perhaps other color care additives thereof, wherein the cationic polymer per se or in combination with non-ionic surfactant and compatible additives adhere to the surface of the fabric, or may adhere to the dye of the fabric via possible covalently bonding or complexation and therefore is capable of forming a film during washing that does not allow the dye to readily migrate from the surface of fabric so as to become waterborne thereby maintaining the fabrics original color.

Further, it is observed that the rate of dye release and change in appearance of fabric has dramatically decreased in the presence of the present composition, and wherein, the composition is capable of providing color retention, better appearance, and less wrinkles to the fabric over multiple wash cycles about 3 to 9 wash cycles.

Therefore, delivery of mixture of cationic polymer with non-ionic surfactant onto a fabric imparts color care benefit and eliminates the limitations of compatibility or stability as described above. This unique combination of cationic polymer with nonionic surfactant results in a stable detergent composition and improved color retention along with effective dye transfer inhibition. Whereas the cationic polymer is found to be unstable in anionic surfactant compositions and the compatibility studies are exemplified in Table 1. Further, the detergent compositions having cationic polymer and compositions without cationic polymer are prepared and analyzed for color retention properties. The compositions are exemplified in Table 2. Homo and copolymers of APTAC monomer and color retention achieved is exemplified in Table 3.

In another embodiment, the present application discloses a method of laundering and/or maintaining the appearance of a fabric, wherein the method comprises (i) washing or contacting one or more fabrics or textile articles with wash solution containing a laundry or cleansing composition at one or more points during the main wash of laundering or cleaning process; (ii) rinsing said fabrics or textile articles with water; and (iii) allowing the fabrics or textile articles to air dry naturally or mechanically tumble-drying them, wherein said composition is capable of exhibiting color wash fastness or color maintenance.

In yet another embodiment, the present application discloses a method of providing appearance of reduced wrinkles and/or reduced lint of a fabric, wherein the method comprises: (i) washing or contacting one or more fabrics or textile articles with wash solution containing a laundry or cleansing composition of the present application at one or more points during the main wash of laundering or cleaning process; (ii) rinsing the fabrics or textile articles with water; and (iii) allowing the fabrics or textile articles to air dry naturally or mechanically tumble-drying them, wherein said fabric is selected from the group consisting of natural fabric, synthetic fabric, natural non-woven fabric and/or synthetic non-woven fabric, cotton, denim, polyacrylics, polyamides, polyesters, polyolefins, rayon, wool, linen, jute, ramie, hemp, sisal, regenerated cellulosic fibers, leather, and combinations thereof.

In still another embodiment, the present application discloses a method of inhibiting transfer of fugitive dyes released during laundering, wherein the method comprises introducing laundry or cleansing composition comprising to a wash liquor of a laundering machine comprising at least one fabric selected from the group consisting of natural fabric, synthetic fabric, natural non-woven fabric and/or synthetic non-woven fabric, cotton, denim, polyacrylics, polyamides, polyesters, polyolefins, rayon, wool, linen, jute, ramie, hemp, sisal, regenerated cellulosic fibers, leather, and combinations thereof.

The laundry or cleaning composition can be a ready-to-use product, an additive rinse cycle composition, or a dilutable detergent for its use in house hold, industrial and/or commercial laundry operations.

The combined multi-functional benefits of this application employs cationic polymers with the potential to provide cost-effective and more environmentally friendly composition by reducing the number, type, and quantity of detergent ingredients and chemicals released into effluent sewage systems.

Laundry Color Wash Fastness Protocol—Laundry color maintenance and dye transfer inhibition studies were carried out in a laboratory scale washer apparatus commonly referred to as a Tergotometer. ASTM Method D-4265 was referenced as a general guideline to conduct laundry evaluations. The conditions for the laundry evaluations were as follows: A pre-determine amount of test detergent was added to a laundry vessel containing 150 ppm ($3Ca^{2+}/1Mg^{2+}$) to bring the total volume to 1.0 liter; laundry bath temperature 38° C./100° F.; standard direct dyed fabrics were added to each bath—six colored fabrics and two white (unless otherwise stated); the fabrics were laundered with the test compositions for 15 minutes, rinsed for 5 minutes the process was repeat for three and/or nine replicates then the fabric swatches were allowed to airline dry. Thirty-six reflectance readings were taken from the dye test fabric before and after laundered for the designated number of cycles using a Hunter Lab Color quest XL Spectrophotometer. Reflectance measurement are used to report color index values, percent color retention, and percent soil percent, the appearance of the materials were additionally evaluated visually in panel test for color wash fastness, and the appearance of less wrinkles and lint. In this application, novel compositions containing cationic polymers were studied for color wash fastness (CWF) performance, Dye transfer inhibition (DTI) properties, and the appearance of less Wrinkles. CWF, DTI, and Wrinkle reduction are mechanistically different laundry color care concepts. Color wash fastness pertains to maintaining the color appearance of garments of the dyed fabric included in the laundry, while DTI embodies the concept of preventing the transfer of dyes from one garment to another during the laundry process. It's measured from the white fabric included in the experiments, and wrinkle reduction is a sensorial appearance attribute scored from the colored test materials. The standard test fabrics used in the research are direct dyed fabrics 0.75% direct blue dye 90 on cotton, Direct Dyed Black22 on Cotton, and STC EMPA 130 cotton direct red dye 83:1. These fabrics were selected as known problematic substrates for color retention and dye transfer inhibition.

FIG. 1 depicts a Standard fabric Direct Blue Dyed 90 on Cotton S/400 test swatches which were laundered three times with nonionic detergent (no polymer additive) and nonionic detergent containing Polymer C125 at 1.0 wt. % on product basis, this detergent was then diluted by adding 1-part detergent fill to 100 parts 150 ppm hard water to create a 1.0 wt. % detergent solution containing 0.002 wt. % active polymer. The laundered materials once dry were then evaluated for color wash fastness (or color retention) performance in a visual panel preference test. Polyacrylamido propyl trimethyl ammonium chloride (Polymer C125) was selected bluer versus the zero polymer composition. A statistically significant result 9 of 10 panelist selected Polymer C125 bluer, after 3 laundry cycles.

Figure 2:
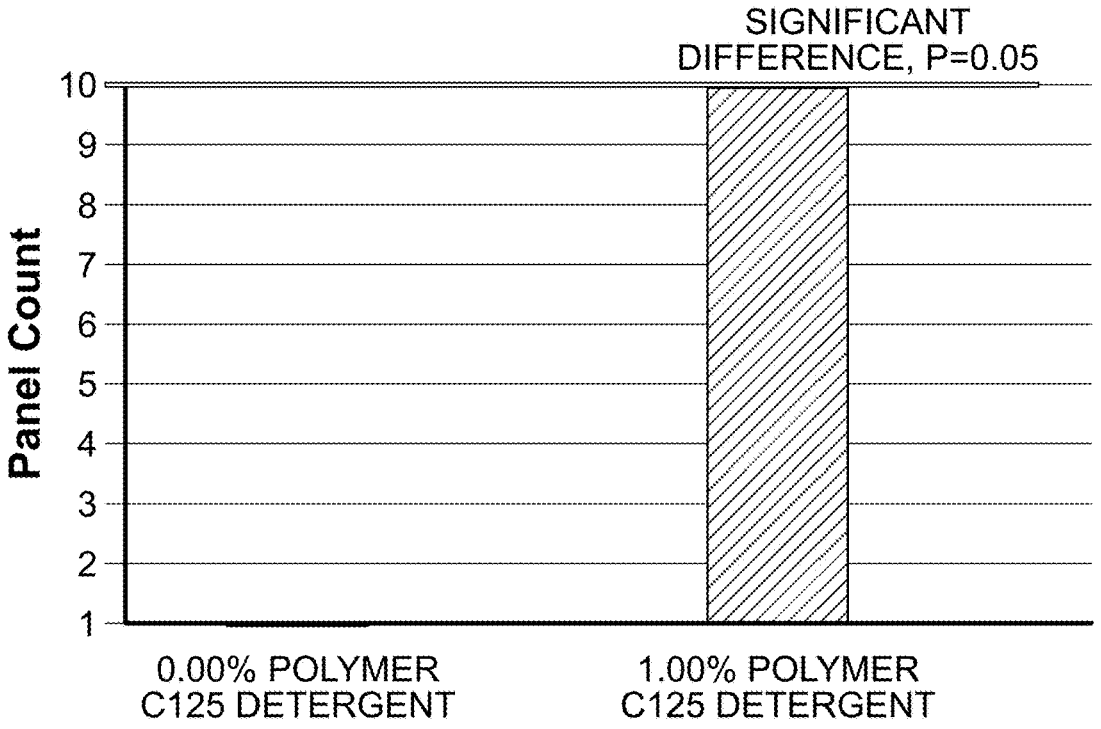
FIG. 2 depicts Visual Color Difference Panel Results on Red Fabric without using polymer C125 detergent and using 1.00% polymer C125 detergent.

FIG. 2 depicts a Standard fabric STC EMPA 130/Direct Dyed Red 83:1 on S/400 test swatches which were laundered three times with nonionic detergent (no polymer additive) and with a nonionic detergent containing 1.0 wt. % Polymer C125 on product basis. This detergent was then diluted by adding 1-part detergent fill to 100 parts with 150 ppm hard water to create a 1.0 wt. % detergent solution containing 20.0 ppm (part per million) active polymer. The laundered materials once dry were then evaluated for color wash fastness (or color retention) in a visual panel preference test. A statistically significant result 10 of 10 panelist selected the Polyacrylamido propyl trimethyl ammonium chloride (Polymer C125) washed materials as more red versus the zero polymer composition, after 3 laundry cycles.

Figure 3:
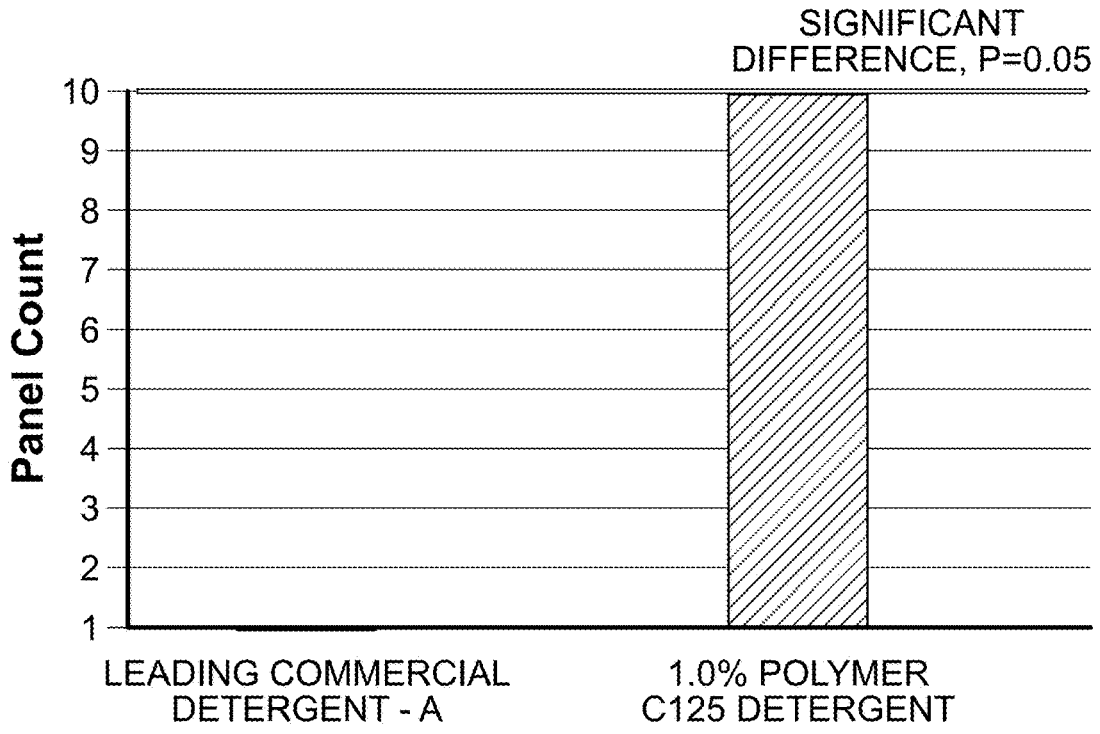
FIG. 3 depicts Visual Color Difference Panel Results using leading commercial detergent A and 1.00 wt. % polymer C125 detergent.

FIG. 3 depicts a Standard fabric STC EMPA 130/Direct Dyed Red 83:1 on S/400 test swatches which were laundered three times with nonionic detergent (no polymer additive) and with a nonionic detergent containing 1.0 wt. % Polymer C125 on product basis. This detergent was then diluted by adding 1 part detergent fill to 100 parts with 150 ppm hard water to create a 1.0 wt. % detergent solution containing 20.0 ppm (part per million) active polymer. The laundered materials once dry were then evaluated for color wash fastness (or color retention) in a visual panel preference test. A statistically significant result 10 of 10 panelist selected the Polyacrylamido propyl trimethyl ammonium chloride (Polymer C125) washed materials as more red versus the zero polymer composition, after 3 laundry cycles.

Accordingly, Appearance Panel Test Protocol—Standard direct dyed test fabrics were laundered for 3 and/or 9 cycles with a select group of detergents, via ASTM Method D-4265. The laundered materials were then prepared for panel evaluation to judge their appearance (for example, the appearance of less wrinkles and lint). In a blind paired comparison evaluation panelist were not told which detergents were used to treat the various sets of test samples. The test samples were presented to each panelist under the same conditions of lighting and staging. Samples were presented to each respondent using the same procedure. In a blind randomized paired comparison respondents were asked to judge the appearance of two sets of fabric swatches placed side-by-side. Panelist was asked to select the sample that best met the attribute in question (for example, the appearance of less wrinkles and lint). The panelist responses were recorded. The results were then analyzed versus the number of responses required to meet a statistically significant level of difference of 0.05% (or a 95% confidence limit) for either sample in the comparison. 10 panelists were polled in each test. A minimum of 9 responds out of 10 are required to select either sample to show a statistically significant and highly preferred result per ASTM Method E2263-12 Paired Preference. With slight modification this procedure was inserted.

Figure 4:
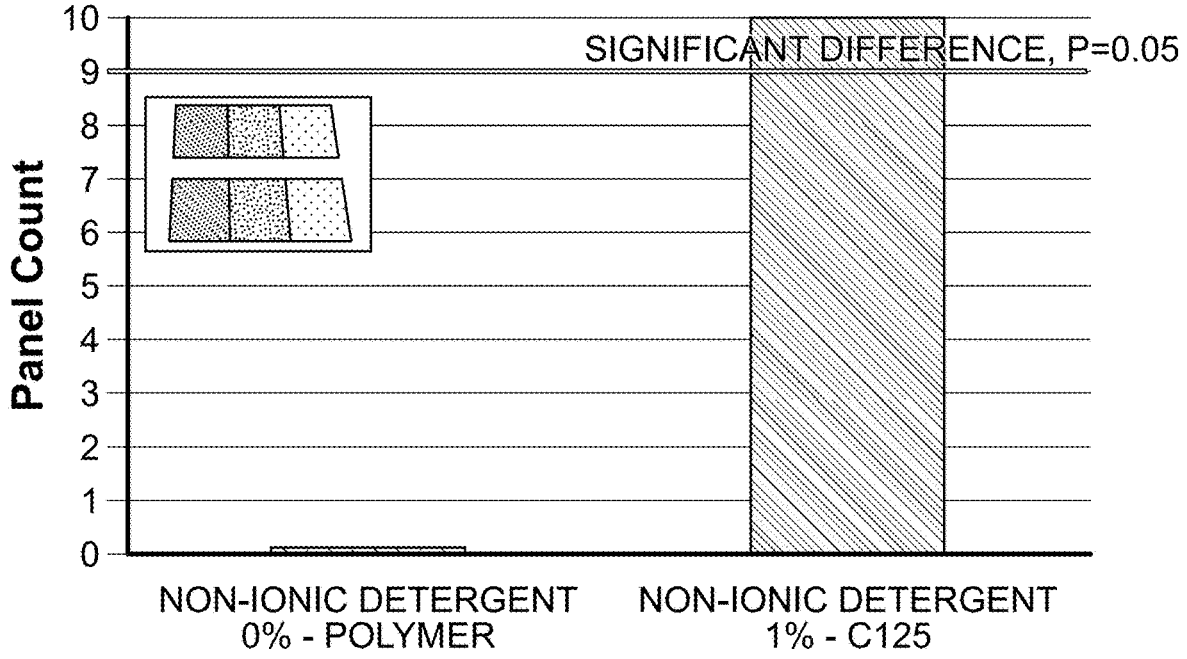
FIG. 4 depicts Appearance Difference Panel Results after evaluation with a detergent having cationic polymer.

FIG. 4 depicts test results of laundered fabric set which appeared smoother with less wrinkles and lint, in a blind paired comparison evaluation with a detergent having no cationic polymer, after 3 laundry cycles.

Figure 5:
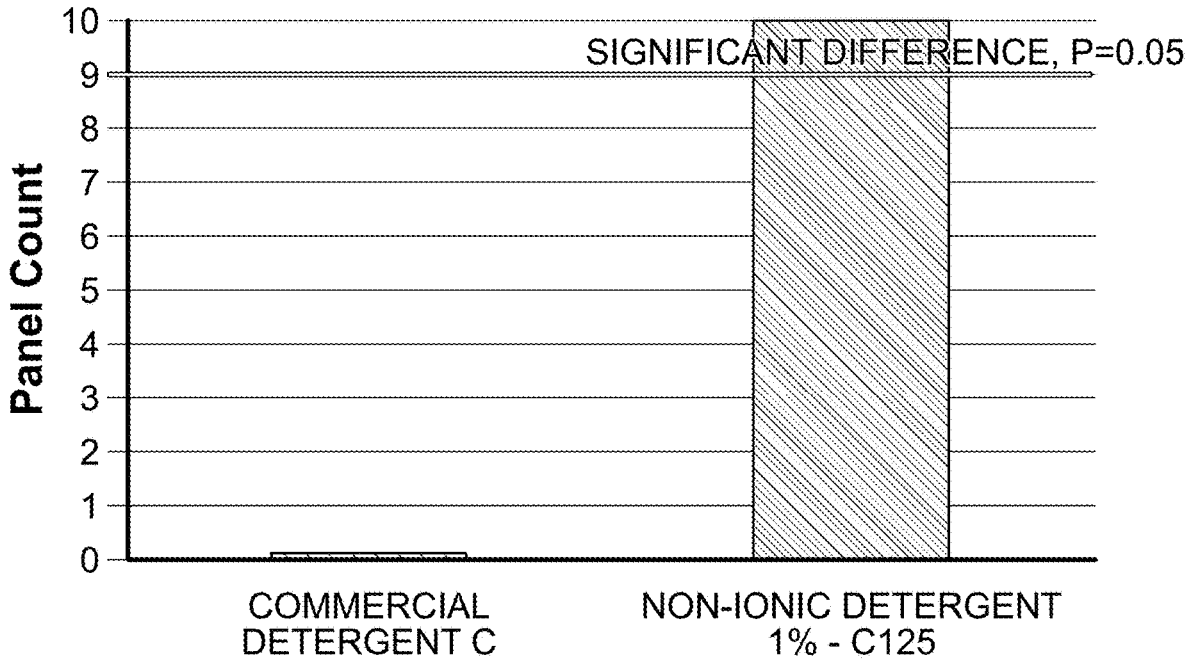
FIG. 5 depicts Appearance Difference Panel Results after evaluation of laundered fabric set with commercial detergent.

FIG. 5 depicts test results of laundered fabric set which appeared smoother with less wrinkles and lint, in a blind comparison evaluation with commercial detergent, after 3 laundry cycles.

Table 4 depicts instrumentation test data, wherein cleaning performance was measured or detergent compositions with and without cationic polymer. APTAC containing detergent showed high color index value and high dye transfer inhibition performance Table 5 depicts corroborated results of visual analysis by panel as well as by instrument.

Dye transfer inhibition and color wash fastness on Blue and Red fabric are provided in Table 6 and Table 7 accordingly. Table 8 shows color maintenance or color wash fastness in terms of color index values for various combinations of homo and copolymers of APTAC.

Further, certain aspects of the present invention are illustrated in detail by way of the following examples. The examples are given herein for illustration of certain aspects of the invention and are not intended to be limiting thereof.

EXAMPLES

Example 1: Laundry Detergent Composition

Surfactants are the most fundamental ingredients found in detergents and cleaning. They are essentially the trademark components defining a composition or formulation as primarily a detergent. The addition of cationic polymer to surfactants added the benefit color wash fastness to form a composition that can be defined as the essential of a color maintenance composition and embodies the broadest description of this application and other optional components may impart other desirable benefits, but not required.

| Composition | F1 (wt. %) |
|---|---|
| Cationic Polymer | 00.50-5.00 |
| Nonionic Surfactant and mixtures thereof (not including anionic surfactants) | 99.50-95.00 |
| Optional ingredients | 00.00-50.00 |
| Balance | 100% |

Example 2: Stability of Cationic Polymers with Anionic and Non-Ionic Detergents The example depicts the stability of cationic polymer in conventional anionic detergent compositions versus the inventive nonionic formulas. The cationic polymer was found to be unstable and not compatible in anionic compositions, however, stable with detergents based on nonionic detergents.

TABLE 1

Stability Comparison of Cationic Polymers with Anionic and Nonionic surfactants

| | Anionic Detergents | | Nonionic Detergents | | |
|---|---|---|---|---|---|
| Components | F1 | F2 | F3 | F4 | F5 |
| Dodecylbenzene sulfonate, sodium salt; (38.59%) | 40.42 (15.60)/ 65:35 | 40.42 (15.60)/ 65:35 | — | — | — |
| Propylene glycol (100%) | — | — | 6.00 | 6.00 | 6.00 |
| Lauryl ($C_{12}$) ether-1EO sulfate, sodium salt, (27.66%) | 30.37 (8.40) | 30.37 (8.40) | — | — | — |
| $C_{12}$-$C_{15}$ linear alcohol 7EO-mole ethoxylate, (100%) | 6/80:20 | 6/80:20 | — | — | — |
| $C_{11}$linear 7 & 3EO-mole ethoxylate(100%) | — | — | 25.00 | 25.00 | 25.00 |
| Ethylediaminetetra acetic acid, disodium salt (99.00%), (commercial grade) | 4.00 | 4.00 | — | — | — |
| Acrylic acid homopolymer, (43.10%) | 1.00 (0.43) | 1.00 (0.43) | — | — | — |
| Distyrylbiphenyl sulfonate (90.00%) | 0.10 | 0.10 | — | — | — |
| Protease, (100%) | 0.50 | 0.50 | 0.10 | 0.10 | 0.10 |
| Sodium xylene sulfonate (40.00%) | 5.00 (2.00) | 5.00 (2.00) | 4.00 | 4.00 | 4.00 |
| Propylene glycol (100% high purity) | 3.00 | 3.00 | — | — | — |
| Deionized water | 9.61 | 8.61 | 64.90 | 63.90 | 60.90 |
| Cationic Polymer(poly-APTAC) | — | 1.00 | — | 0.50 | 5.00 |
| Balance | 100.00 | 100.00 | 100.00 | 100.00 | 100.00 |
| Physical Stability | | | | | |
| 120 F./50 C. (1-2-3 weeks) | pass | fail | pass | pass | pass |
| 74 F./23 C. (1-2-3 weeks) | pass | fail | pass | pass | pass |
| 14 F./−10 C. (1-2-3 weeks) | pass | fail | pass | pass | pass |

Example 3: Detergent Compositions

TABLE 2

Prototype Laundry Detergent utilized to screen cationic polymers for performance.

| | wt. % | | | |
|---|---|---|---|---|
| Composition | F1 | F2 | F3 | F4 |
| DI Water | 64.90 | 63.90 | 63.90 | — |
| Propylene Glycol (100%) | 6.00 | 6.00 | 6.00 | — |
| Protease, (100%) | 0.10 | 0.10 | 0.10 | — |
| Sodium xylene sulfonate (40.00%), C12-C15 linear 7-mole (75%) & 3-mole (25%) alcohol ethoxylate blend of nonionic (100%) | 4.00 | 4.00 | 4.00 | — |
| | 25.00 | 25.00 | 25.00 | — |
| Polymer (product basis) | — | — | — | — |
| Det. (zero polymer) | 0.00 | — | — | — |
| Det. Polymer C125 (20%) (polyAPTAC) | — | 1.00 | — | — |
| Commercial Product | — | — | — | — |
| Balance | 100% | 100% | 100% | 100% |

Example 4: A Diverse Group of Cationic Polymers and Color Retention Laundry Results Poly APTAC homopolymer and a variety of cationic terpolymer added to Formula 2 on product basis versus and screened for color wash fastness against a commercial color care product. All the cationic polymers showed better color retention versus the commercial control. Percentage of color retention (Table 3)

TABLE 3

Cationic Polymers and Color Retention Data

| Cationic Polymer (percent solids) | Basis monomer | DADMAC | Hydro-phobic (wt. %) | Anionic | Color Retention |
|---|---|---|---|---|---|
| (20.00%) | poly-APTAC (100.00) | 0.00 | 0.00 | 0.00 | 97.70 |
| (40.00%) | poly-APTAC (83.50) | 10.00 | BEM(1.50) | AA(5.00) | 95.82 |
| (40.00%) | poly-APTAC (93.50) | 0.00 | BEM(1.50) | AA(5.00) | 95.55 |
| (24.60%) | poly-APTAC (93.50) | 0.00 | SA(1.50) | AA(5.00) | 95.91 |
| (24.60%) | poly-APTAC (93.50) | 0.00 | SA(1.50) | AA(5.00) | 95.87 |
| Commercial Product | — | — | — | — | 95.51 |

Color retention (%) - significant difference plus or minus 0.05

Example 5: Panel Test Results

A standard test fabric of 0.75% direct blue dye 90 on cotton were evaluated with detergent having zero polymer and later with detergent having cationic polymer (20%). Panelists observed that they were able to see significant color maintenance difference in the two formulations after washing 3-cycles with blue fabric. These observations are shown in FIG. 1. Similar results were observed when tests were repeated on red fabric using polyAPTAC homopolymer added to detergent base and compared to the detergent base lacking the homopolymer wherein the panelists were able to see a significant color maintenance difference in two formulations after washing 3 cycles. These observations are shown in FIG. 2. Later the tests were extended to commercially available detergents with color care additives and compared with the inventive detergent formulation with C125 cationic polymer. Panelists were able to see significant color maintenance difference and favored polymer C125 over the leading commercial detergent after 3 wash cycles on red fabric depicted in FIG. 3.

Example 6: Spectroscopic Reflectance Test Results Depicting Color Retention, Detergent Cleaning, and Dye Transfer Inhibition Color index was measured wherein higher values equal better color maintenance. Detergent polymer C125 (polyAPTAC) showed highest color index. The cleaning performance was measured as cleaning percent soil removal, the higher the value the better the cleaning performance. The nonionic surfactant based detergents performs well, Polymer C125 out performs the conventional anionic commercial detergent for detergency. Dye transfer inhibition (DTI) properties of the polymers were also evaluated. DTI performance was measured as percentage and higher the percentage value more effective is the composition against dye transfer.

TABLE 4

Instrumentation Test Data

| Polymer (%) | Wt. (%) | | |
|---|---|---|---|
| Det. (zero polymer) | 0.00 | — | — |
| Det. Polymer C125 (polyAPTAC) (20%) | — | 1.00 | — |

TABLE 4-continued

Instrumentation Test Data

| Polymer (%) | Wt. (%) | | |
|---|---|---|---|
| Commercial Product | — | — | — |
| Color Maintenance (direct red color index value) | 0.926 | 0.938 | 0.912 |
| Dye Transfer Inhibition Performance (%-Whiteness retention) | 31.77 | 70.57 | 20.71 |

Example 7: Comparative Test Data

The visual panel results and instrumentation results were corroborated and found that detergent polymer C125 shows better results than the commercial or zero polymer detergent (Table 4).

TABLE 5

Comparative Test Data

| Polymer added | Color Index Value | | |
|---|---|---|---|
| Det. (zero polymer) | 0.00 | — | — |
| Det. Polymer C125 (20%) | — | 1.00 | — |
| Commercial Product | — | — | — |
| Color Maintenance (direct blue color index values) | 0.323 | 0.327 | 0.319 |

Example 8: APTAC Homopolymer in Different Percentages

APTAC homopolymer containing detergent showed best results of color maintenance (color wash fastness) and dye transfer inhibition, polymer was tested for various percentages showing high and low concentration of the polymer C125 on red fabric.

TABLE 6

| APTAC Polymers and Color Maintenance | | | | | |
|---|---|---|---|---|---|
| Polymer | Color Index Value | | | | |
| Det. (zero polymer) | 0.00 | — | — | — | — |
| Det. Polymer C125 (20%) | — | 0.50 | — | — | — |
| Det. Polymer C125 (20%) | — | — | 1.00 | — | — |
| Det. Polymer C125 (20%) | — | — | — | 2.00 | — |
| Det. Polymer C125 (20%) | — | — | — | — | 4.00 |
| Color Maintenance (direct red color index | 0.926 | 0.929 | 0.929 | 0.930 | 0.938 |

Example 9: Dye Transfer Inhibition on Blue Fabric

Dye transfer inhibition on blue fabric was analyzed. APTAC homopolymer containing detergent showed high values.

TABLE 7

| Dye Transfer Inhibition (DTI) on Blue Fabric | | | |
|---|---|---|---|
| Polymer (product basis) | DTI Results | | |
| Det. (zero polymer) | 0.00 | — | — |
| Det. Polymer C125 (20%) | — | 1.00 | — |
| Commercial Product | — | — | — |
| Composition DTI performance (%-whiteness retention) | 56 | 87 | 58 |

Example 10: Read-to-Use or Dilutable, Non-Cleaner Laundry Additive

| Compositions | F1 (wt. %) |
|---|---|
| Cationic Polymer | 00.0010-10.00 |
| Diluent, deionized water | 99.999-90.00 |
| Balance | 100% |

Example 11: Cationic Polymers at Diluted Ready-to-Use Compositions in Rinse Water Exemplifying Rinse Additive Color Wash Fastness Table 8 depicts the enhanced performance polyDADMAC and the performance of varying molecular weight polyAPTAC cationic polymers versus a commercial standard. Example 11 shows a color wash fastness benefit due to contacting fabrics with the embodied cationic polymer by contacting test materials in a bath containing the polymer or immersing cloth or garments into water and post adding and diluting a composition containing the inventive polymer. If a nonionic detergent is not used in the laundry wash cycle a composition of Example 1 could be added to the laundry rinse cycle.

TABLE 8

| Detergent Compositions | | | | | |
|---|---|---|---|---|---|
| Cationic Polymers Compositions | F-a | F-b | F-c | F-d | Commercial Standard |
| Polymer | | | | | |
| Polymer C125 (20% solids) 300K | 0.04% active | — | — | — | — |
| DADMAC (34.2% solids) | — | 0.04% active | — | — | — |
| Polymer C125 (24% solids) 500K | — | — | — | — | — |
| Polymer C125 (24% solids) 850K | — | — | 0.04% active | — | — |
| APTAC/AMPS/BEM (39% solids) | — | — | — | 0.04% active | — |
| Color Maintenance (red dye color index values) | 0.936 | 0.914 | 0.916 | 0.912 | 0.912 |

While this invention has been described in detail with reference to certain preferred embodiments, it should be appreciated that the present invention is not limited to those precise embodiments. Rather, in view of the present disclosure, many modifications and variations would present themselves to those skilled in the art without departing from the scope and spirit of this invention.

What is claimed is:

1. A method of laundering and/or maintaining the appearance of a fabric comprising the steps of:

(i) washing or contacting one or more fabrics or textile articles with a wash solution containing a laundry or cleansing composition at one or more points during the main wash of laundering or cleaning process;

(ii) rinsing said fabrics or textile articles with water; and (iii) allowing said fabrics or textile articles to air dry naturally or mechanically tumble-drying them, wherein said composition is capable of exhibiting color wash fastness or color maintenance, and wherein the laundry or cleansing composition comprises:

a) from about 0.0010 wt. % to about 50 wt. % of at least one cationic polymer selected from the group consisting of poly acrylamidopropyl trimethyl ammonium chloride (PolyAPTAC), poly(acrylamidepropyltimethylammoniumchloride-behenylmethacrylate-acrylicacid) terpolymer, poly (acrylamidopropyltrimethyl ammonium chloride-stearyl acrylate-acrylic acid) terpolymer, and poly (acrylamidopropyl trimethyl ammonium chloride-stearyl acrylate-acrylamidopropyl methane sulfonic acid) terpolymer; and has a molecular weight of from about 100,000 to about 1,000,000 daltons;

b) from about 0.01 wt. % to about 50 wt. % of at least one non-ionic surfactant which is a linear ethoxylated alcohol having a carbon chain length of C12 to C15;

c) optionally, from about 0.001 wt. % to about 5 wt. % of at least one enzyme; and d) optionally, from about 0.01 wt. % to about 25 wt. % of at least one laundry or cleaning additive, wherein the composition exhibits color maintenance or color wash fastness of 95% to 99% for 3 wash cycles, measured in accordance with ASTM Method D-4265.

2. The method according to claim 1, wherein said cationic polymer is present in the range of about 0.001 wt. % to about 0.004 wt. %, or about 0.0015 wt. % to about 0.003 wt. %.

3. The method according to claim 1, wherein said non-ionic surfactant may further comprise a surfactant selected from the group consisting of additional alcohol ethoxylates, alkyl polyglucosides, alkyl phenol ethoxylates, alkyl alkanolamides, alkyl amine oxides, non-ionic block copolymers, glycerols, glyceryl esters, and mixtures thereof.

4. The method according to claim 1, wherein said laundry or cleaning additive is compatible with the cationic polymers of claim 1, and is selected from the group additional surfactants, alkaline builders, chelants, colorants or dyes, hydrotropes or solubilizing agents, foam control agents, dispersants, fillers compounds, functional polymers, stabilizers, rheology modifiers, fluorescent whitening agents or optical brighteners, solvents, fragrance or perfumes, soil release polymers, preservatives, antimicrobials, insect repellents, dust mite repellents, UV absorbers, light management agents, bleaching agents, oxidation catalysts, zeolites, and/or odor suppressing agents.

5. The method according to claim 1, wherein said enzyme is selected from the group consisting of proteases, amylases, cellulases, oxidases, peroxidases, and/or lipases.

6. The method according to claim 1, wherein said composition exhibits:

color maintenance or color wash fastness of 97% for 3 wash cycles, measured in accordance with ASTM Method D-4265.

7. The method according to claim 1, wherein the composition is used for household, industrial and/or commercial laundry operations.

8. The method according to claim 1, wherein said composition is used in the form of liquid, solid, semisolid, emulsion, powder, dispersion or gel.

9. The method according to claim 1, wherein the composition is a ready-to-use product, an additive rinse cycle composition, or a dilutable detergent.

10. A method of providing appearance of reduced wrinkles and/or reduced lint of a fabric comprising the steps of:

(i) washing or contacting one or more fabrics or textile articles with wash solution containing a laundry or cleansing composition at one or more points during the main wash of laundering or cleaning process;

(ii) rinsing said fabrics or textile articles with water; and (iii) allowing said fabrics or textile articles to air dry naturally or mechanically tumble-drying them, wherein said fabric is selected from the group consisting of natural fabric, synthetic fabric, natural non-woven fabric and/or synthetic non-woven fabric, cotton, denim, polyacrylics, polyamides, polyesters, polyolefins, rayons, wool, linen, jute, ramie, hemp, sisal, regenerated cellulosic fibers, leather, and combinations thereof, and wherein the laundry or cleansing composition comprises:

a) from about 0.0010 wt. % to about 50 wt. % of at least one cationic polymer selected from the group consisting of poly acrylamidopropyl trimethyl ammonium chloride (PolyAPTAC), poly(acrylamidepropyltrimethylammoniumchloride-behenylmethacrylate-acrylicacid) terpolymer, poly (acrylamidopropyltrimethyl ammonium chloride-stearyl acrylate-acrylic acid) terpolymer, and poly (acrylamidopropyl trimethyl ammonium chloride-stearyl acrylate-acrylamidopropyl methane sulfonic acid) terpolymer; and has a molecular weight of from about 100,000 to about 1,000,000 daltons;

b) from about 0.01 wt. % to about 50 wt. % of at least one non-ionic surfactant which is a linear ethoxylated alcohol having a carbon chain length of C12 to C15;

c) optionally, from about 0.001 wt. % to about 5 wt. % of at least one enzyme; and d) optionally, from about 0.01 wt. % to about 25 wt. % of at least one laundry or cleaning additive, wherein the composition exhibits color maintenance or color wash fastness of 95% to 99% for 3 wash cycles, measured in accordance with ASTM Method D-4265.

11. A method of inhibiting transfer of fugitive dyes released during laundering, the method comprising introducing a laundry or cleansing composition to a wash liquor of a laundering machine comprising at least one fabric selected from the group consisting of natural fabric, synthetic fabric, natural non-woven fabric and/or synthetic non-woven fabric, cotton, denim, polyacrylics, polyamides, polyesters, polyolefins, rayons, wool, linen, jute, ramie, hemp, sisal, regenerated cellulosic fibers, leather, and combinations thereof, and wherein the laundry or cleansing composition comprises:

a) from about 0.0010 wt. % to about 50 wt. % of at least one cationic polymer selected from the group consisting of poly acrylamidopropyl trimethyl ammonium chloride (PolyAPTAC), poly(acrylamidepropyltrimethylammoniumchloride-behenylmethacrylate-acrylicacid) terpolymer, poly(acrylamidopropyltrimethyl ammonium chloride-stearyl acrylate-acrylic acid) terpolymer, and poly(acrylamidopropyl trimethyl ammonium chloride-stearyl acrylate-acrylamidopropyl methane sulfonic acid) terpolymer; and has a molecular weight of from about 100,000 to about 1,000,000 daltons;

b) from about 0.01 wt. % to about 50 wt. % of at least one non-ionic surfactant which is a linear ethoxylated alcohol having a carbon chain length of C12 to C15;

c) optionally, from about 0.001 wt. % to about 5 wt. % of at least one enzyme; and d) optionally, from about 0.01 wt. % to about 25 wt. % of at least one laundry or cleaning additive, wherein the composition exhibits color maintenance or color wash fastness of 95% to 99% for 3 wash cycles, measured in accordance with ASTM Method D-4265.

* * * * *